US005826310A

United States Patent [19]

Hobday

[11] Patent Number: 5,826,310

[45] Date of Patent: Oct. 27, 1998

[54] BAR CLAMP APPARATUS

[75] Inventor: Harold W. Hobday, Galt, Calif.

[73] Assignee: Hobday Clamp Company, Pleasanton, Calif.

[21] Appl. No.: 940,647

[22] Filed: Sep. 30, 1997

Related U.S. Application Data

[60] Provisional application No. 60/027,328 Sep. 30, 1996.

[51] Int. Cl.[6] ..... A44B 21/00; B25B 5/00

[52] U.S. Cl. ..... 24/514; 24/522; 24/525; 24/569; 269/6

[58] Field of Search ..... 24/514, 522, 525, 24/535, 569; 269/4, 5, 6

[56] References Cited

U.S. PATENT DOCUMENTS

| | | | |
|---|---|---|---|
| 556,239 | 3/1896 | Ashald et al. | 24/514 |
| 774,211 | 11/1904 | Totten | 24/522 |
| 3,039,161 | 6/1962 | Gagnon | 24/514 |
| 4,220,322 | 9/1980 | Hobday . | |
| 5,161,787 | 11/1992 | Hobday . | |
| 5,217,213 | 6/1993 | Lii | 269/6 |
| 5,454,551 | 10/1995 | Hobday . | |

*Primary Examiner*—Victor N. Sakran
*Attorney, Agent, or Firm*—John P. O'Banion

[57] ABSTRACT

A bar clamp apparatus having a pair of opposing clamp jaws, with one of the clamp jaws slidably joined to a handle member. The handle member and attached clamp jaw are slidably mounted on a bar. The clamp jaw attached to the handle member includes a pin which slidably engages a pair of corresponding slots or tracks in the handle member, to allow the clamp jaw to slidably move relative to the handle member. A knob has an attached threaded screw which passes through a threaded bore in the handle member with the end of the screw contacting the clamp jaw on the handle member. Rotation of the knob advances the screw and moves and applies pressure to the clamp jaw attached to the handle member. A workpiece is positioned between the clamp jaws, and the first clamp jaw is moved towards the second clamp jaw by rotating the knob to advance the screw thereby holding the workpiece between the clamp jaws.

1 Claim, 4 Drawing Sheets

BAR CLAMP APPARATUS

CROSS-REFERENCE TO RELATED APPLICATIONS

This application claims priority from U.S. provisional application Ser. No. 60/027,328 filed on Sep. 30, 1996.

BACKGROUND OF THE INVENTION

1. Field of the Invention

This invention pertains generally to hand actuated clamping devices and methods, and more particularly to a bar clamp apparatus which provides for quick and accurate positioning of jaw members for gripping a workpiece.

2. Description of the Background Art

Various hand-actuated clamping mechanisms are known and used to holding workpieces for manufacturing and machining operations. Bar clamps typically utilize a pair of clamp jaws movably mounted on a bar or rod. A workpiece is positioned between the clamps, and one or both of the clamp jaws are moved along the bar and tightened about the workpiece to hold the workpiece between the clamp jaws on the bar.

Previously used bar clamps have generally proved deficient in that they are difficult and time consuming to position and tighten about a workpiece. A particular problem is that currently known bar clamp devices are limited in the amount of force which can be applied to a workpiece, and thus cannot provide sufficient holding power to prevent movement of the workpiece during certain machining or manufacturing operations. Further, presently available devices do not allow careful control of the amount of force applied to a workpiece. Certain items, such as wood panels, will undergo damage on the surfaces adjacent the clamp jaws if too much force or pressure is applied to the item by the clamp jaws. Another drawback experienced with previously used bar clamps is that accurate positioning of the clamp jaws is not easily achieved, and thus machining errors or defects can result in the workpiece held by the bar clamp device.

Accordingly, there is a need for a bar clamp apparatus which can exert a high level of applied pressure to a workpiece, which has increased holding power, which provides for quick and accurate releasable holding of a workpiece, which allows precise control of the amount of force or pressure exerted on a workpiece between a pair of clamp jaws, and which allows accurate clamp jaw positioning. The present invention satisfies these needs, as well as others, and generally overcomes the deficiencies found in the background art.

SUMMARY OF THE INVENTION

The present invention is a hand-actuated bar clamp apparatus which provides a high level of holding power or force on a workpiece, which allows accurate positioning of a movable clamp jaw with respect to a stationary clamp jaw, and which allows control over the amount of force applied to a workpiece between a pair of clamp jaws. In general terms, the invention comprises a handle member which is slidably mounted on a bar, a first, positionally adjustable clamp jaw which is slidably attached to the handle member, a second, stationary clamp jaw mounted on the bar, hand or finger actuated means for incrementally moving or advancing the handle along the bar towards the second clamp jaw, braking means for preventing backsliding of the first clamp jaw along the bar, and means for slidably adjusting the position of the first clamp jaw relative to the handle member.

By way of example, and not of limitation, a finger grip or lever is pivotally mounted to the handle member. A spring loaded driving lever is included within the handle. Hand actuation of the finger grip biases the driving lever and causes the driving lever to grip the bar and cause the handle member and attached clamp jaw to move forward along the bar. By repeated actuation of the finger grip, the driving lever, and thus the attached handle and clamp jaw are moved incrementally forward along the bar. The second clamp jaw is positioned at a desired location on the bar and remains stationary after positioning, with the first clamp jaw moving towards the second clamp jaw under the action of finger grip and driving lever. A spring loaded braking lever is included on the handle member which prevents backsliding or backward motion of the first clamp jaw and handle member unless the braking lever is released. A pair of slots are included in a portion of the handle member, and the first clamp member includes a corresponding pair of studs or pins which slidably engage the slots. A rotatable knob is attached to a threaded screw, and the threaded screw engages and passes through a threaded hole in the handle so that the end of the screw is positioned adjacent the back of the first clamp jaw. The screw is advanced or retracted by rotating the knob. As the screw advances, the end of the screw pushes against the first clamp jaw and pushes the first clamp jaw forward towards the second clamp jaw. The pins on the first clamp jaw slidably move within the slots of the handle member as the screw is moved.

A workpiece is positioned between the first and second clamp jaws, and actuation of the finger grip and driving lever are used to position the first and second clamp jaws about the workpiece by moving the handle member along the bar. The knob is rotated to incrementally advance the first clamp jaw and apply a holding force to the workpiece between the clamp jaws. The position of the first clamp jaw can be precisely controlled by rotation of the knob and attached screw. A higher level of holding force can be applied to the workpiece than is possible with conventional bar clamp devices. The amount of force applied to the workpiece can be carefully controlled by positioning the screw to prevent pressure damage to the workpiece.

An object of the invention is to provide a bar clamp apparatus which can deliver a high level of applied pressure and holding power for holding a workpiece.

Another object of the invention is to provide a bar clamp apparatus which allows quick, easy and accurate incremental adjustment of the amount of force applied by a pair of clamp jaws to a workpiece.

Another object of the invention is to provide a bar clamp apparatus which allows precise incremental adjustment of clamp jaw positioning.

Another object of the invention is to provide a bar clamp apparatus which allows quick release of a workpiece from a pair of clamp jaws.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 3:
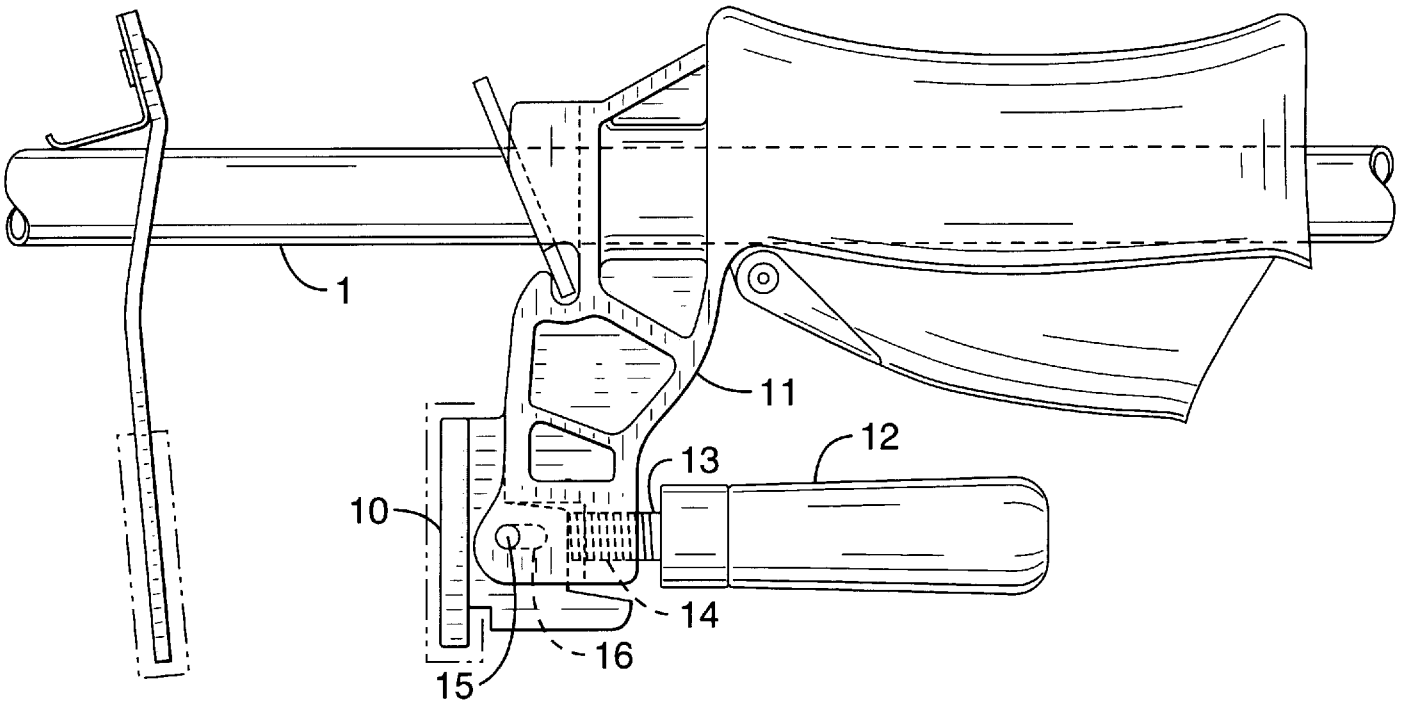
FIG. 3 is a side elevation view of the present invention adapted to the bar clamp device shown in FIG. 1.
Figure 4:
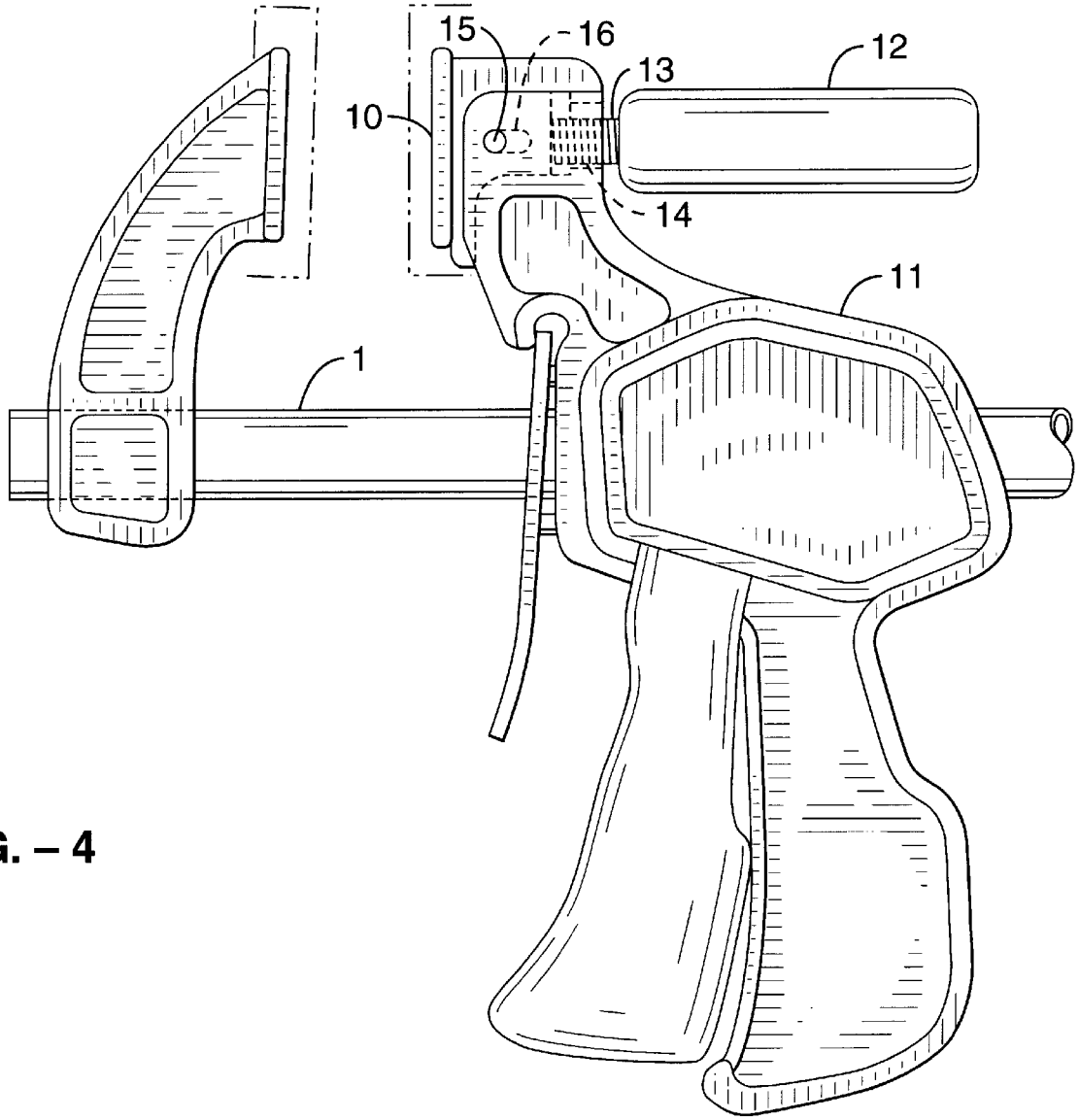
FIG. 4 is a side elevation view of the present invention adapted to the bar clamp device of shown in FIG. 2.

Referring more specifically to the drawings, for illustrative purposes the present invention is embodied in the apparatus generally shown in FIG. 3 and FIG. 4, where like reference numerals denote like parts. It will be appreciated that the apparatus may vary as to configuration and as to details of the parts without departing from the basic concepts as disclosed herein.

Figure 1:
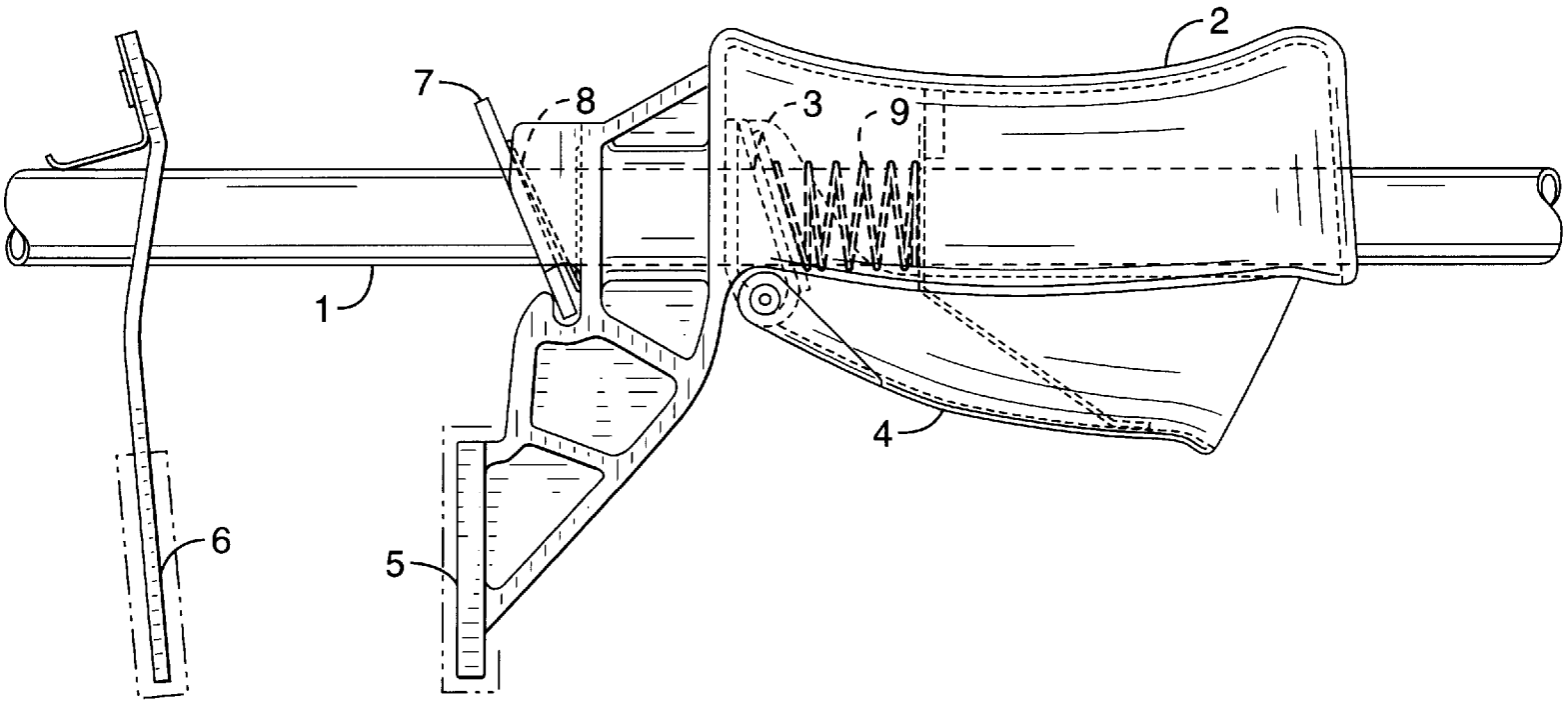
FIG. – 1 (PRIOR ART)
FIG. 1 is a side elevation view of a prior art bar clamp device in which the handle member is positioned generally parallel to the clamp support bar.

Referring first to FIG. 1, an Easy Hold II™ bar clamp device manufactured by Adjustable Clamp Company is generally shown. The apparatus uses a bar 1, and a handle member 2 is slidably mounted on bar 1 through a bore which extends through handle member 2. A spring loaded driving lever 3 is included in handle member 2. Driving lever 3 is actuated by a pistol-like finger grip or lever 4 which is pivotally mounted on handle member 2. A first clamping jaw 5 is joined to handle member 2. A second clamping jaw 6 is mounted on bar 1. A spring loaded braking lever 7 is included with handle member 2, and a spring 8 provides bias to braking lever 7. Spring 9 provides bias to driving lever 3.

Driving lever 3, while at rest or in a static or standby mode, is held essentially at a right angle to bar 1 by spring 9. While in the static or standby mode, driving lever 3 does not move or restrict bar 1. When finger lever 4 is activated by a user in a conventional, pistol-like fashion, finger lever 4 biases driving lever 3, causing driving lever 3 to grip bar 1 and move forward along bar 1 towards second clamp jaw 6. Successive or repeated squeezing and releasing of finger lever 4 causes driving lever 3, and thus handle member 2 and first clamp jaw 5, to move forward along bar 1 towards second clamp jaw 6.

Braking lever 7, while engaged, is biased by spring 8 so that braking lever 7 grips bar 1 in a manner such that first clamp jaw 5 and the attached handle member 2 can only move in the forward direction towards second clamp jaw 6. When braking lever 7 is manually released, first clamp jaw 5 can freely slide or move forward or backward along bar 1 when pushed by a user. Note that, while braking lever 7 is engaged, first clamp jaw 5 can be pushed forward manually, although with some resistance.

The Easy Hold II™ bar clamp device of FIG. 1 is used by positioning second clamp jaw 6 along bar 1 in a desired position. A workpiece (not shown) is positioned between first and second clamp jaws 5, 6. Braking lever 7 is engaged, and first clamp jaw 5 is incrementally moved along bar towards second clamp jaw 6 by actuating finger lever 4 until the workpiece is held between first and second clamp jaws 5, 6. First clamp jaw 5 is advanced along bar 1 until the workpiece is held between the clamp jaws 5, 6. In order to release the workpiece from first and second clamp jaws 5, 6, braking lever 7 is released or disengaged, and first clamp jaw 5 is slidably moved backward along bar 1 or away from second clamp jaw 6 to release the workpiece.

Figure 2:
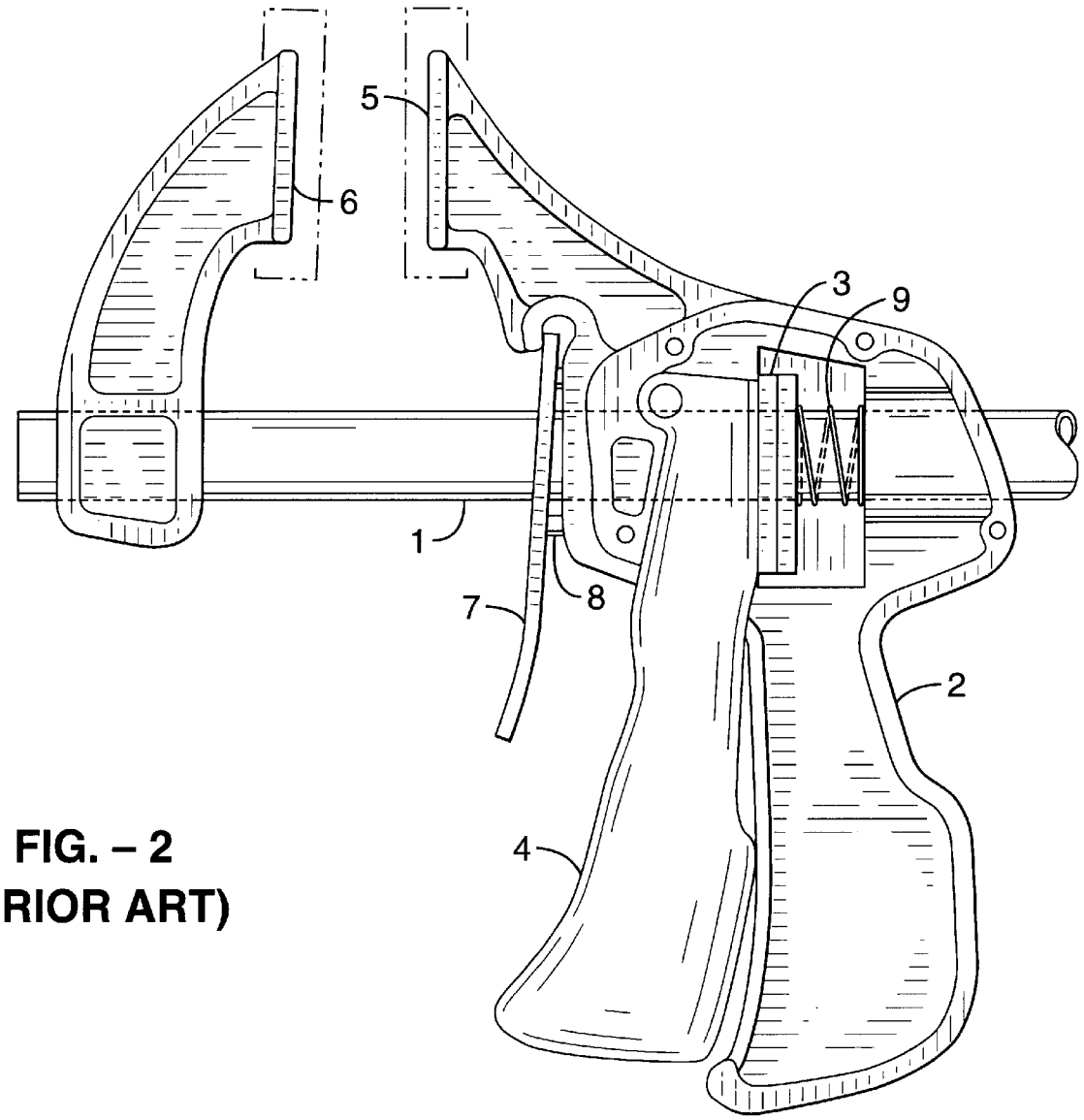
FIG. – 2 (PRIOR ART)
FIG. 2 is a side elevation view of a prior art bar clamp device in which the handle member is positioned generally perpendicular to the clamp support bar.

Referring now to FIG. 2, a QuickGrip™ bar clamp device manufactured by American Tool Company is generally shown, wherein like reference numerals denote like parts. As shown in FIG. 2, handle member 2 and finger lever 4 are generally perpendicular to bar 1. The bar clamp apparatus of FIG. 2 operates in a manner which is generally identical to that described above for the bar clamp apparatus of FIG. 1, and differs only in the orientation of the handle member 2 and finger lever 4 relative to bar 1.

The accuracy of the positioning of first and second clamp jaws 5, 6 relative to each other is limited in the bar clamp devices shown in FIG. 1 and FIG. 2, since amount of control by a user over the positioning of driving lever 3 by actuation of finger lever 4 is limited. For the same reasons, the amount of holding pressure applied to a workpiece between clamp jaws 5, 6 is difficult to control in these prior art bar clamp devices.

Referring now to FIG. 3, the bar clamp apparatus of FIG. 1 is shown in combination with the present invention. The invention comprises an improved clamp jaw 10 which is loosely, slidably mounted or pinned to a handle member 11 to allow movement of clamp jaw 10 with respect to handle member 11. Forward movement by clamp jaw 10, and additional holding pressure on a workpiece are provided by a knob 12 and attached screw 13 which is threaded through a bore 14 in the upper portion of handle 11. Clamp jaw 10 is movably mounted onto handle member 11 by means of pin 15 on clamp jaw 10 which slidably and pivotally engage corresponding slots 16 on handle member 11. Screw 13 bears directly against clamp jaw 10 and, by rotating knob 12, screw 13 is moved incrementally forward or backward as required to tighten or loosen clamp jaw 10 with respect to a workpiece (not shown). As screw 13 advances or retracts through bore 14 due to the rotation of knob 12, pin 15 slide within slots 16. The range of motion of clamp jaw 10 relative to handle member 11 is limited by the dimension or length of slots 16. The pin 15 allows clamp jaw 10 to automatically pivot as necessary to provide a more stable grip on a workpiece.

Referring now to FIG. 4, the bar clamp apparatus of FIG. 2 is generally shown with the present invention, with like reference numerals used to denote like parts. The handle member 11 of the apparatus of FIG. 4 is perpendicularly oriented with respect to the bar 1. Otherwise, the bar clamp apparatus of FIG. 4 operates in a manner which is generally identical to that described above for the bar clamp apparatus of FIG. 3.

The use by the invention of clamp jaw 10 which is slidably mounted on handle member 11, together with screw 13 and rotatable knob 12, allow precise incremental positional adjustment of clamp jaw 10. The use of screw 13 and knob 12 to slidably move clamp jaw 10 relative to handle additionally allows application of higher levels of holding power on a workpiece (not shown), and more precise control over amount of force applied to a workpiece, than is possible with currently available bar clamp devices.

Accordingly, it will be seen that this invention provides a hand operated bar clamp apparatus which can exert a high level of applied pressure to a workpiece, which has increased holding power, which provides for quick and accurate releasable holding of a workpiece, which allows precise control of the amount of force or pressure exerted on a workpiece between a pair of clamp jaws, and which allows precise positioning of a clamp jaw. Although the description above contains many specificities, these should not be construed as limiting the scope of the invention but as merely providing illustrations of some of the presently preferred embodiments of this invention.

What is claimed is:

1. A bar clamp apparatus, comprising:

(a) a first jaw and a second jaw, said first jaw opposing said second jaw;

(b) a handle member, said handle member including a first bore and a second bore, said first jaw slidably mounted to said handle member adjacent said second bore;

(c) a bar, said bar attached to said second jaw, said bar slidably engaged within said first bore of said handle member;

(d) actuating means for incrementally moving or advancing said handle member along said bar towards said second jaw;

(e) braking means to prevent retracting of said handle member along said bar; and (f) a knob, said knob threadably engaged within said second bore, said knob capable of slidably moving said first jaw relative to said handle member.

* * * * *